United States Patent [19]

Seaton et al.

[11] 4,033,403

[45] July 5, 1977

[54] SYNCHRONIZING VELOCITY AND POSITION CONTROL

[75] Inventors: William W. Seaton, Dexter; George C. Miller, Ann Arbor, both of Mich.

[73] Assignee: Seaton Engineering Company, Ann Arbor, Mich.

[22] Filed: Sept. 17, 1975

[21] Appl. No.: 614,088

[52] U.S. Cl. ..... 164/155; 164/136; 104/18; 105/311 R; 141/137; 198/751; 214/43

[51] Int. Cl.[2] ..... B22C 25/00

[58] Field of Search ..... 164/154, 155, 136, 281, 164/335; 198/19–21; 214/43; 246/182 B; 104/18; 105/311 R; 82/53.1; 83/295; 141/137

[56] References Cited

UNITED STATES PATENTS

| | | | |
|---|---|---|---|
| 3,122,800 | 3/1964 | Naffziger | 164/155 |
| 3,283,918 | 11/1966 | Devol | 198/19 |
| 3,310,855 | 3/1967 | Orioli | 82/53.1 |
| 3,369,432 | 2/1968 | Davis | 82/53.1 |
| 3,537,489 | 11/1970 | Hall | 214/43 |

*Primary Examiner*—Leonidas Vlachos

[57] ABSTRACT

The relative positions between a pair of moving objects and the velocity of one of such objects is controlled so as to synchronize the movements of the objects. Synchronization is achieved through the use of a novel sensor mechanism and a control circuit associated therewith. The sensor mechanism, which may be mounted on a molten metal pouring machine, includes a moving beam which carries a probe which describes the same circular arc regardless of where positioned on the beam. The probe contacts an object on a conveyor, for example a mold to be poured, and a signal generator mechanically coupled to the moving beam will provide an output signal commensurate with the relative position and velocity of the tool and workpiece.

20 Claims, 5 Drawing Figures

SYNCHRONIZING VELOCITY AND POSITION CONTROL

BACKGROUND OF THE INVENTION:

1. Field of the Invention

The present invention relates to controlling the relative velocities and positions of a pair of moving objects and particularly to synchronizing the movements of a parallelly movable tool with the movements of workpieces traveling on a continuously operating conveyor. More specifically, this invention is directed to a sensor for use in controlling the speed and position of a first mechanism relative to a moving object and to a control system utilizing such sensor. Accordingly, the general objects of the present invention are to provide novel and improved methods and apparatus of such character.

2. Description of the Prior Art

While not limited thereto in its utility, the present invention is particularly well suited to use in controlling a foundary operation and particularly the pouring of molten metal into moving molds. A summary of the state of the art with respect to the pouring of molten metal into spatially displaced molds traveling on a preferably continuously operating conveyor may be found in U.S. Pat. No. 2,522,031. In view of the obvious and numerous disadvantages of prior art apparatus such as that discussed in U.S. Pat. No. 2,522,031 such apparatus has achieved only limited utilization and success in pouring machines for traveling mold conveyors in the United States. Nevertheless, there has been a long standing desire in the art for such apparatus in view of its substantial utility in the production of many consumer products such as, for example, engine blocks for motor vehicles.

The principal deficiency of prior art pouring machines has resided in the area of control where an accurate and reliable mechanism for obtaining and maintaining synchronized speed and a desired relative position between the pouring machine and the traveling molds has not previously been available. Thus, by way of example, prior attempts to sense mold position by establishing mechanical contact therewith have been characterized by lack of reliability and serviceability; the sensors being particularly susceptible to damage incident to "breakaway" as accompanies overtravel between the mold and pouring machine. Also, prior art controls for synchronizing pouring machine and mold speed have been comparatively costly. While prior art electronic controls have had the capability of synchronizing the speed of the pouring machine to that of the conveyor on which the molds to be poured were traveling, such electronic controls have been insensitive to position variations incident to the always present oscillations of the conveyor; such oscillations resulting in the speed of the mold varying about that established by the conveyor drive motor. Attempts to overcome this problem of position insensitivity have resulted in complex controls, some of which have had a tendency to "hunt".

SUMMARY OF THE INVENTION

The present invention overcomes the above briefly discussed and other deficiencies and disadvantages of the prior art by providing a novel and improved velocity and position control particularly well suited for use in synchronizing the velocity and position of a pouring machine to molds positioned on a continuously moving conveyor. Thus, in accordance with the present invention, a pouring machine or other tool or apparatus will be provided with a sensor mechanism including a probe mounted on a moving beam. The probe, which can preferably be adjustably positioned along the beam to establish the desired relative position between the apparatus on which the sensor is mounted and the object which is to be followed in speed and position when such apparatus and object are in synchronism, will be contacted by the object. As a result of contact between the probe and moving conveyor supported object, the beam will be moved. The beam of the sensor mechanism constitutes one side of a pivotally mounted parallelogram which, in addition to movements induced by force applied to the probe by a mold or other object, can be moved between an operative and retract position. Movements of the parallelogram are transmitted via a Geneva mechanism to cams which control limit switches and a signal generator. The output of the signal generator is commensurate with the displacement due to the force applied by the mold or other object to the probe and thus is a measure of the velocity of the contracted object relative to the apparatus on which the sensor is mounted. This velocity error signal is employed to adjust the speed of the carrier apparatus, a pouring machine in the example being described, so as to bring its speed into synchronism with that of a mold.

A particularly unique feature of the present invention resides in the use of a sensor mechanism wherein the probe is mounted on a moving beam so as to describe the same circular arc regardless of is position along the beam. This arrangement permits the desired relative position between the two moving objects of interest to be selectively adjusted without any further changes or adjustments being made to the control. A further unique feature of the invention resides in the mounting of the sensor mechanism parallelogram in such a manner that the sensor will accommodate without damage the retract, normal operative and override positions.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

Figure 1:
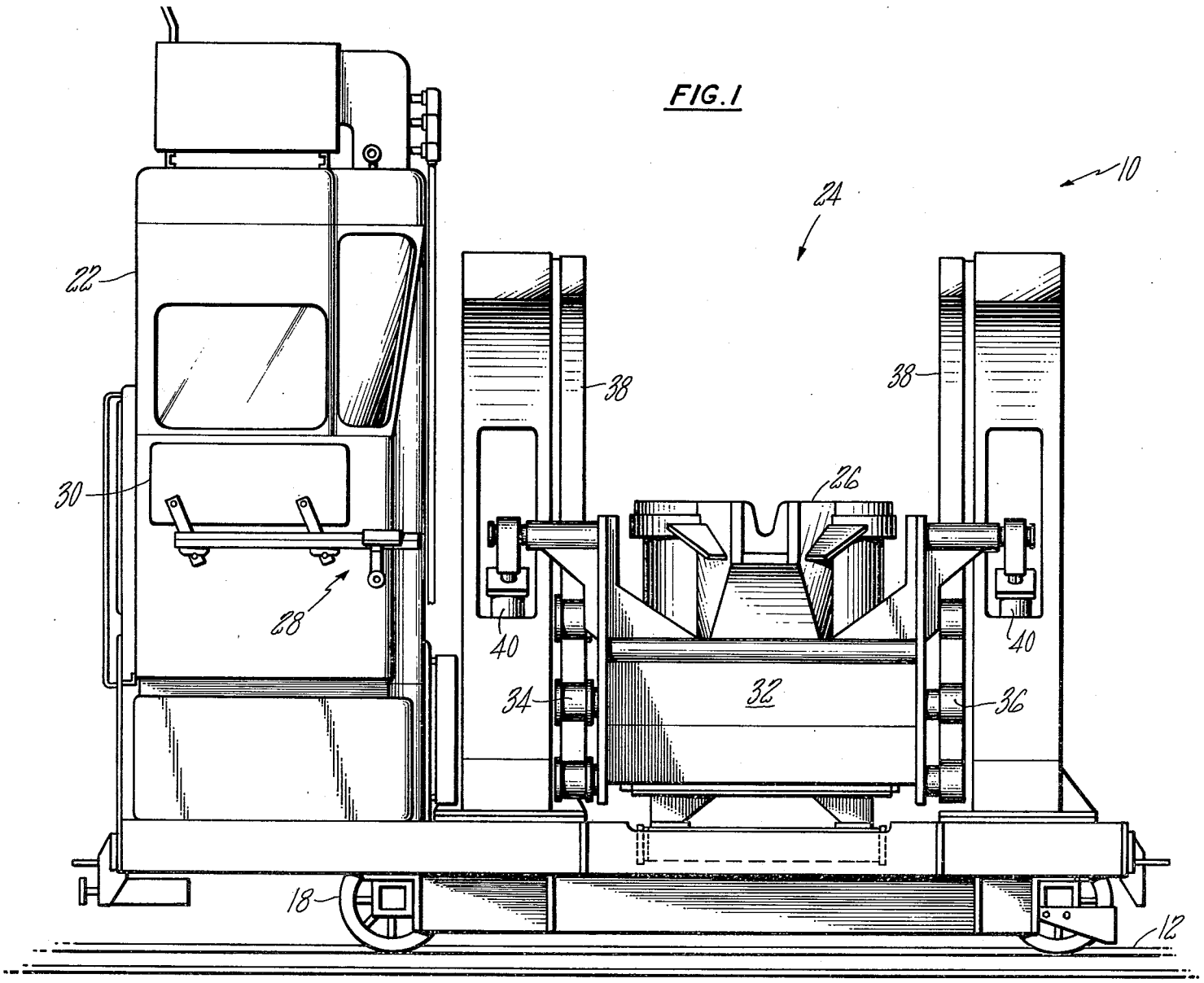
FIG. 1 is a side elevation view of pouring apparatus incorporating a speed and position control in accordance with a preferred embodiment of the invention.

DESCRIPTION OF THE PREFERRED EMBODIMENT:

With reference now to FIG. 1, a "pour" car incorporating the present invention is indicated generally at 10. Pour car 10 is driven, by means of a variable speed hydraulic motor, not shown, along tracks 12. As may be seen from FIG. 2, tracks 12 are oriented parallelly to a conveyor 14. Molds to be poured, as indicated at 16, 16' and 16'', are positioned on conveyor 14 by means which do not comprise part of the present invention. Molds 16 may, for example, be of the conventional synthetic bonded sand, resin bonded sand, sintered investment ceramic or permanent mold types or any other type mold may be employed.

As noted above, the pouring car 10 is driven along rails 12 by means of a variable speed hydraulic motor; this motor being mounted directly in the axis of the driving wheels 18. The driving wheels 18 are doubly flanged and are connected to the hydraulic drive motor through geared couplings at each end of a through shaft on the motor. In accordance with the disclosed embodiment of the invention, speed and position control of the pouring car are achieved through the use of an axial piston type variable displacement hydraulic pump coupled to the drive motor. This pump, which is indicated schematically in FIG. 5 at 122, includes a "wobble plate". The angle of this wobble plate determines the direction of rotation and speed of the hydraulic motor and thus of the pouring car. The angle of the pump wobble plate is controlled by a zero control assembly which will be described below in the discussion of FIG. 5.

The pouring car 10 includes, as its major subsystems, a control cab 22 and a supporting and tilting mechanism, indicated generally at 24, for a ladle 26. During a "manual" mode of operation, the cab 22 provides the operator with a clear unobstructed view of the stream of molten metal being discharged from ladle 26 as he controls the pouring operation. Cab 22 is provided with appropriate environmental controls so as to afford the operator a safe and comfortable vantage point. The operator a safe and comfortable vantage point. The operator is provided with control levers for use in controlling the motion of the pouring car and for controlling the tilting of ladle 26. A sensor mechanism, which forms part of the control for automatically synchronizing the speed and position of the pouring car with that of a mold traveling on conveyor 14, is mounted from the front of the cab 22 as indicated generally at 28. The housing 30 for that portion of the synchronizing control to which the sensor 28 is mechanically coupled is mounted on the front of cab 22 as shown; the housing 30 and the component parts it shields being shown isolated from the remainder of the control mechanism in FIG. 4.

Figure 2:
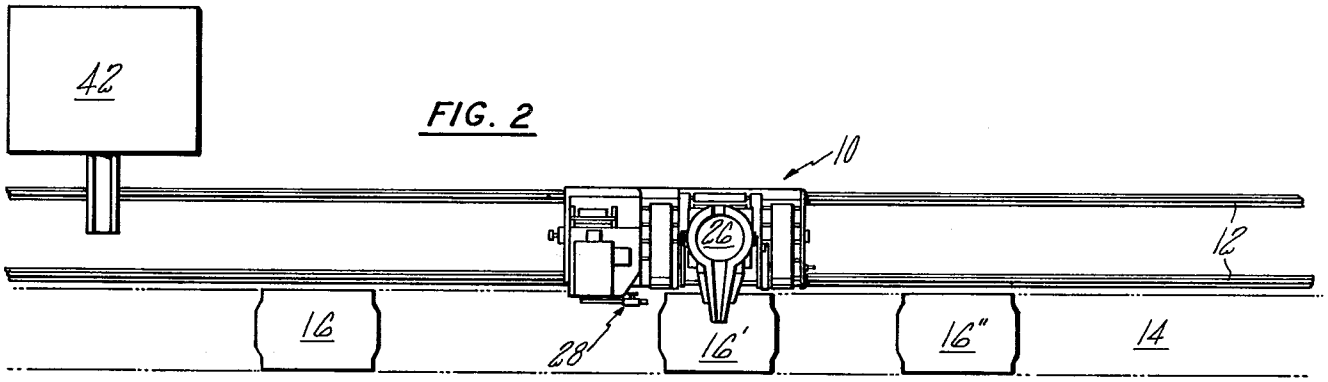
FIG. 2 is a schematic top plan view representing a foundary line employing the pouring apparatus depicted in FIG. 1.

Referring jointly to FIGS. 1 and 2, the ladle 26 is cradled in a carriage 32 and is caused to tilt about the end of its spout. During the tilting operation the ladle is carried upwardly with carriage 32. Carriage 32 is fitted with double flanged rollers 34 on one end and smooth rollers 36 on the opposite end. Two rollers on each end of carriage 32 are provided with eccentric hubs to permit adjustment of the rollers for wear and proper clearance on the parallel curved rails 38 on which the rollers move. Movement of carriage 32 and ladle 26 is achieved through the use of a pair of hydraulic cylinders 40—40. Cylinders 40 are clevis mounted to the car at their lower ends and are coupled to the carriage assembly 32 by means of spherical bushings. Energization of cylinders 40, for example under control of the operator, will cause the carriage and ladle to move upwardly on curved sections of rails 38 to produce a virtual axis of tilting at the spout of ladle 26. The tilting about the ladle spout end results in a uniform height of the spout above the mold at all times.

A pouring car in accordance with the present invention may be operated in accordance with any one of several modes. Thus, the ladle 26 may be replenished at a furnace, such as indicated at 42 in FIG. 2, while remaining on the pouring car. Alternatively, full ladles may be exchanged for empty ladles by means not depicted herein. The actual mold pouring operation may be controlled manually or automatically; automatic control being accomplished through the use of appropriate logic circuitry. Regardless of which mode of operation is selected, synchronization of the speed and position of the pouring car relative to a moving mold, so as to enable pouring, will be achieved employing the sensor mechanism and control system as FIGS. 3, 4 and 5.

Figure 4:
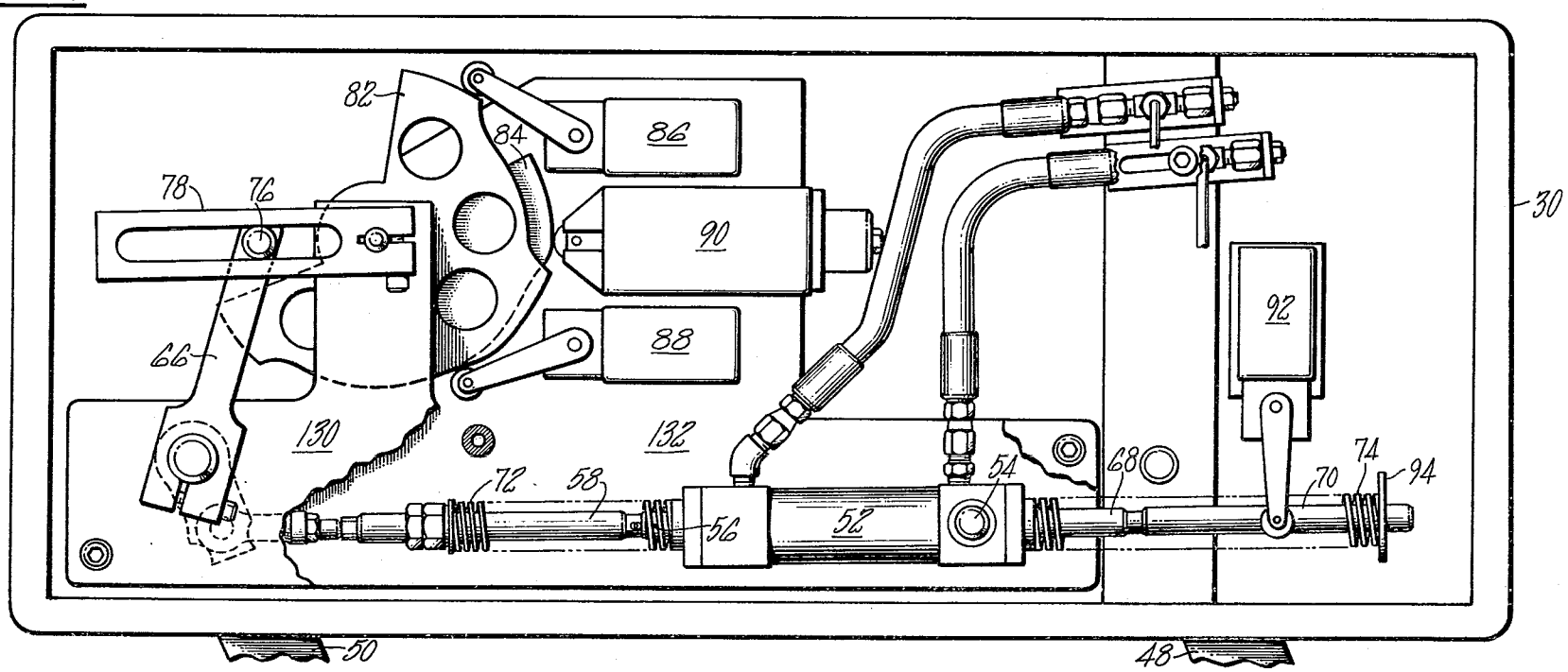
FIG. 4 is a side elevation view of a portion of the sensor mechanism of FIG. 3.
Figure 3:
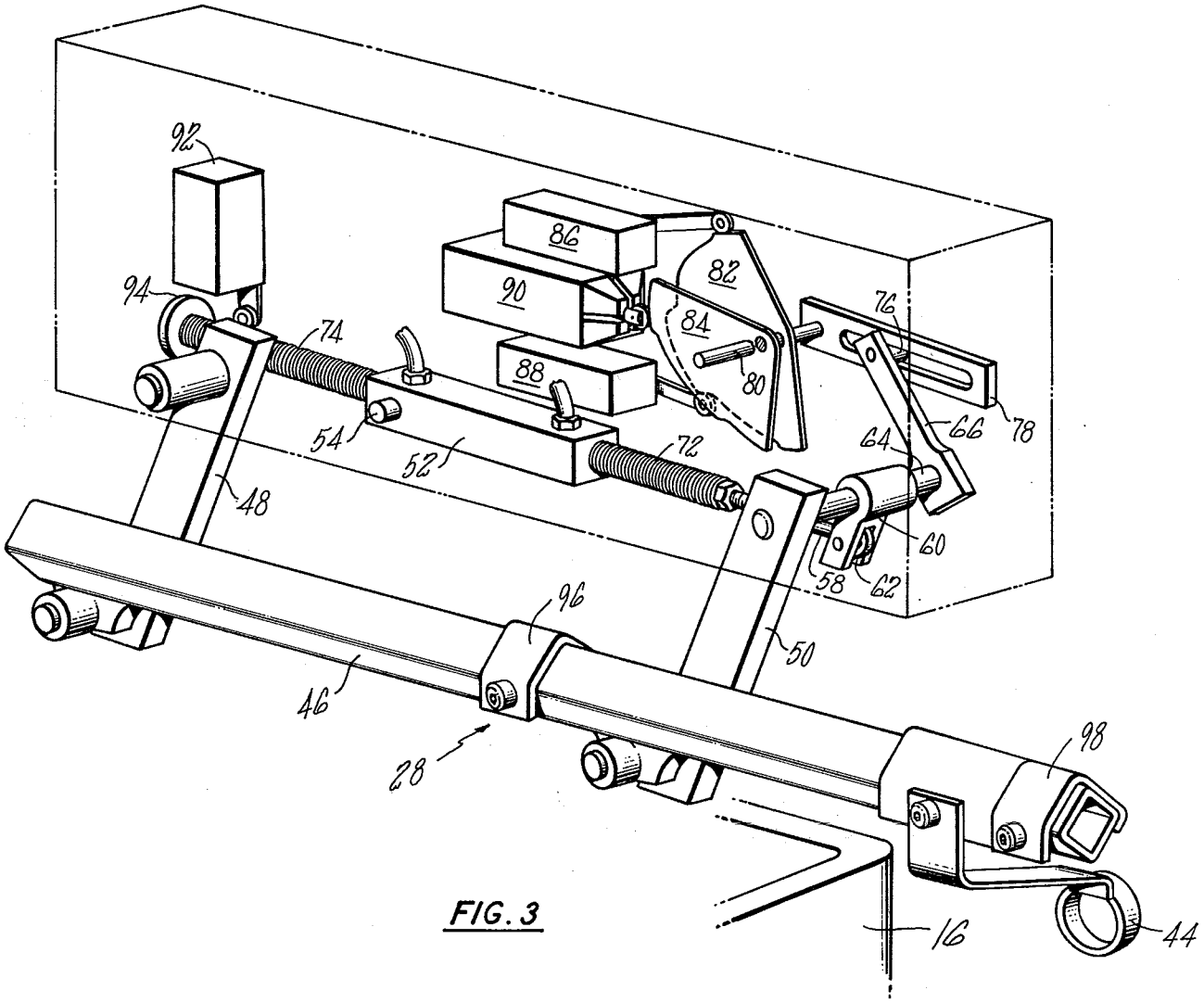
FIG. 3 is a perspective schematic view of a sensor mechanism in accordance with a preferred embodiment of the present invention.

Referring now jointly to FIGS. 3 and 4, the sensor or control signal generating portion of the synchronizing control in accordance with the preferred embodiment of the present invention is shown. The sensor mechanism 28 includes a mold contacting probe 44 which, in the operative position, will contact the leading edge of the mold to be poured. Probe 44 is mounted on a beam 46 which is suspended from an idler arm 48 and input arm 50. The beam 46, and thus the sensor mechanism 28, has an operative zone and a retract position. In the retract position the arms 48 and 50 are caused, in the manner to be described below, to pivot so as to raise probe 44 upwardly a sufficient distance so that it will not contact a mold on conveyor 14; the arms moving in the counterclockwise direction as the sensor is shown in FIG. 3.

The means by which the beam 46 is moved between its operative zone and retract positions includes a double ended hydraulic cylinder 52 which is trunnion mounted to a plate 130 of housing or frame 30 of the sensor mechanism as indicated at 54. A piston rod 56 extends from a first end of cylinder 48 and is coupled, via a front piston extension rod 58, to input arm 50. This coupling is accomplished by means of a further arm 60; the end of the front rod extension 58 disposed remotely of piston rod 56 being pivotally connected to the lower end of arm 60 as indicated at 62 and the opposite end of arm 60 being rigidly connected to pivot pin 64 which extends between the upper end of input arm 50 and the lower end of a driver arm 66. A second or rear piston rod 68 extends from the end of cylinder 52 oppositely to piston rod 56. Piston rod 68 is provided with a rear piston rod extension 70 which floats with cylinder 52.

The beam 46, the parallel idler and input arms 48 and 50 respectively, and the sensor assembly frame define a parallelogram which is shown in the neutral spring position; i.e., the position assumed by the probe 44 after it has been released from the retract position and dropped and is awaiting contact by a moving mold. With the probe dropped but contact not established with a mold, the pouring car will be commanded to move at an intercept velocity which is less than the speed of the conveyor on which the molds are traveling.

The hydraulic cylinder 52 may be deenergized either automatically, in response to the sensing of the proximity of a mold in a manner to be briefly described below, or under the control of the operator. Deenergization of cylinder 52 will permit beam 46 to fall while reenergization of cylinder 52 will raise the beam 46 and probe 44 to the retract position. In the automatic mode a limit switch, not shown, will be contacted by a mold thus generating a signal which controls the dropping of the sensor beam 46. In the manual mode the operator actuates a valve to cause the beam to drop. When the sensor beam has been dropped to the position shown both control ports of the double ended cylinder 52 are opened and the cylinder is thus in the "float" or "intercept" position. When the sensor is in the "intercept" position the cylinder 52 floats and the hydraulic fluid recirculates from one port through a valve to the other port thus providing adjustable damping for the motion of the spring mass system of probe, beam and arms. This adjustable damping is achieved by means of flow control valves associated with the cylinder ports.

A pair of compression springs 72 and 74 are respectively coaxial with the piston rods 56 and 68. Springs 72 and 74 are preloaded to establish a desired float position for the sensor mechanism. Thus, the opposed springs 72 and 74 locate the probe 44 at a neutral position which allows contact with a mold across the entire sensing range of the control system while at the same time allowing the sensor mechanism to override in both directions. In an override condition, for example when the mold overtravels the sensor to a position outside of the operative range, motion of the sensor mechanism is permitted by the opposed springs regardless of the relative velocity. Accordingly, the probe and beam will not be damaged during an override. During a synchronizing operation, when the probe is dropped, the cylinder 52 will, as noted above, act as a damper for the spring mass including the beam 46.

As also noted above, the upper end of input arm 50 is connected to a driver arm 66 by means of a pivot pin 64 whereby driver arm 66 will follow the motions of beam 46. The second or opposite end of driver arm 66 is provided with a drive roller 76 which is engaged in the slot of a Geneva arm 78. Geneva arm 78 drives, via a pin 80, a pair of rotatable cams 82 and 84. Cam 82 is a limit switch cam while cam 84 is a LVDT cam. Cam 82 controls the position of the operating arms of, and thus the electrical state of, a pour authorization switch 86 and an override switch 88. Cam 84 contacts the spring loaded plunger of a linear variable differential transformer (LDVT) 90. The sensor assembly also includes a further limit switch 92 which is actuated by a flange 94 on rear piston rod extension 70 to provide an indication whether or not the beam 46 is in the retract position. The output of switch 92 is thus an enabling signal which indicates that it is safe for the pour car to come up to speed to approach a mold to be poured.

Considering further the mechanical response to movements of input arm 50, when the driver arm 66 and Geneva arm 78 are parallel the plunger on the LDVT 90 is centered on cam 84 and the LVDT core is in the null position. At this time the pour car will be traveling in synchronism with the mold. The Geneva arm 78 is employed because it affords a mechanical amplification of the angular relationship between pins 64 and 80 in the sensing zone while motion is attenuated in the retract or overtravel positions thus safeguarding the cams 82 and 84 from shock damage. The use of a Geneva arm also permits operation of the two limit switches 86 and 88 off a single cam. Thus, the Geneva arm 60 increases the sensitivity of the probe in the central operating region or zone of cam 84 while deadening motion with the sensor in the retract position or under an overtravel condition.

Referring again to FIG. 4, it may be seen that the various elements of the sensor mechanism located within housing 30 are sandwiched between a pair of frame plates 130 and 132; the frame plates being separated by spacers on posts which pass through the subassembly. The sandwiching of the components of the sensor including the LVDT 90, hydraulic cylinder 52, cam shaft bearings and trunnion bearing between plates 130 and 132 affords the protection which permits a precise instrument to operate in a hostile environment while simultaneously providing an uncomplicated construction. The entire sensor "sandwich" assembly is mounted from the front of housing 30 in such a manner as to provide the sensor with a measure of isolation from thermally induced distortions of the housing.

Referring again to the beam 46 and probe 44, it is to be noted that the beam is provided with a pair of adjustable stops 96 and 98 positioned to either side of probe 44. The stops 96 and 98 are clamped or tack welded to beam 46 while probe 44 is movable so as to be brought into abutment with top 96 as shown or stop 98. The stops 96 and 98 establish a pair of relative positions between the pour car and mold at the null position of cam 84. This ability to vary relative position is important since it permits the use of different ladle configurations on the pouring car. It is to be noted that the probe 44 will describe the same circular arc regardless of where positioned on beam 46.

Before discussing the overall control system as shown schematically in FIG. 5, the operation of the sensor assembly of FIGS. 3 and 4 will be described. It will be presumed that the pouring car is traveling in the same direction as a mold but at a slower speed than the mold to be poured; i.e., the pouring car is moving at the intercept velocity. Presuming that the sensor has been released from the retract position, at this time the springs 72 and 74 will be maintaining the beam 46 and thus the input arm 50 in the neutral spring intercept position. With arm 50 in the intercept position a first high response zone on the LVDT cam 84 will be in contact with the plunger of LVDT 90 and the transformer will generate a control signal commensurate with an "intercept" speed less than conveyor speed. When the leading edge of the mold contacts probe 44, the beam 46 will be urged to the right as the assembly is shown in FIG. 3 or to the left as the assembly is shown in FIG. 4. This results in spring 72 being compressed as the input arm 50 moves from the neutral spring position.

The motion of beam 46 resulting from pushing movement of a mold against probe 44 will be transmitted to the driver arm 66 via input arm 50 and pivot pin 64. The rotational movement of pivot pin 64 will be amplified and transmitted to pin 80 by the Geneva arm 78; pin 80 thus generating a rotating moment which is applied to cams 82 and 84.

The LVDT cam 84 is a linear cam having a central low response region and a pair of high response end regions; the middle of the central region being the null or sync point of the system where driver arm 66 and Geneva arm 78 are aligned and idler arm 48 and input arm 50 are oriented vertically in the preferred embodiment. Movement of cam 84 resulting from a mold pushing against probe 44 will result in the low response central region of the cam being brought into contact with the plunger of LVDT 90. The resulting movement of the core of LVDT 90 with respect to its two transformer windings will vary the output voltage of the LVDT. The change in LVDT output voltage, in the manner to be described below, will be sensed and employed to adjust the speed of the pouring car to synchronize such speed with that of the mold.

With the sensor in the neutral spring or intercept position shown in FIGS. 3 and 4, the pour authorization switch 86 will have been closed by cam 82 thus providing both an indication that tipping of the ladle is not yet permitted and a control input which will prevent tipping. The override switch 88 will be in a high region of cam 82 and switch 88 will be closed thus indicating that the mold has overridden the operative range of the sensor. The override signal provided by switch 88 is, however, ignored until synchronization has been achieved. The limit switch 92, which is operated by flange 94, will also be in the open condition thus providing an indication that the beam 46 has dropped and thus the car may be brought up to speed to intercept a mold.

In the retract position the relationship of the cams to LVDT plunger and switch actuator arms will be opposite to that shown in FIGS. 3 and 4; i.e., the LVDT plunger will be on the high response region at the opposite end of cam 84, the pour authorization switch 86 will be closed by contact of its actuator arm with a "high" zone on cam 82 and the override switch 88 will be closed by contact of its actuator arm with a high zone adjacent an end of cam 82. In the retract position limit switch 92 will be closed by flange 94.

Figure 5:
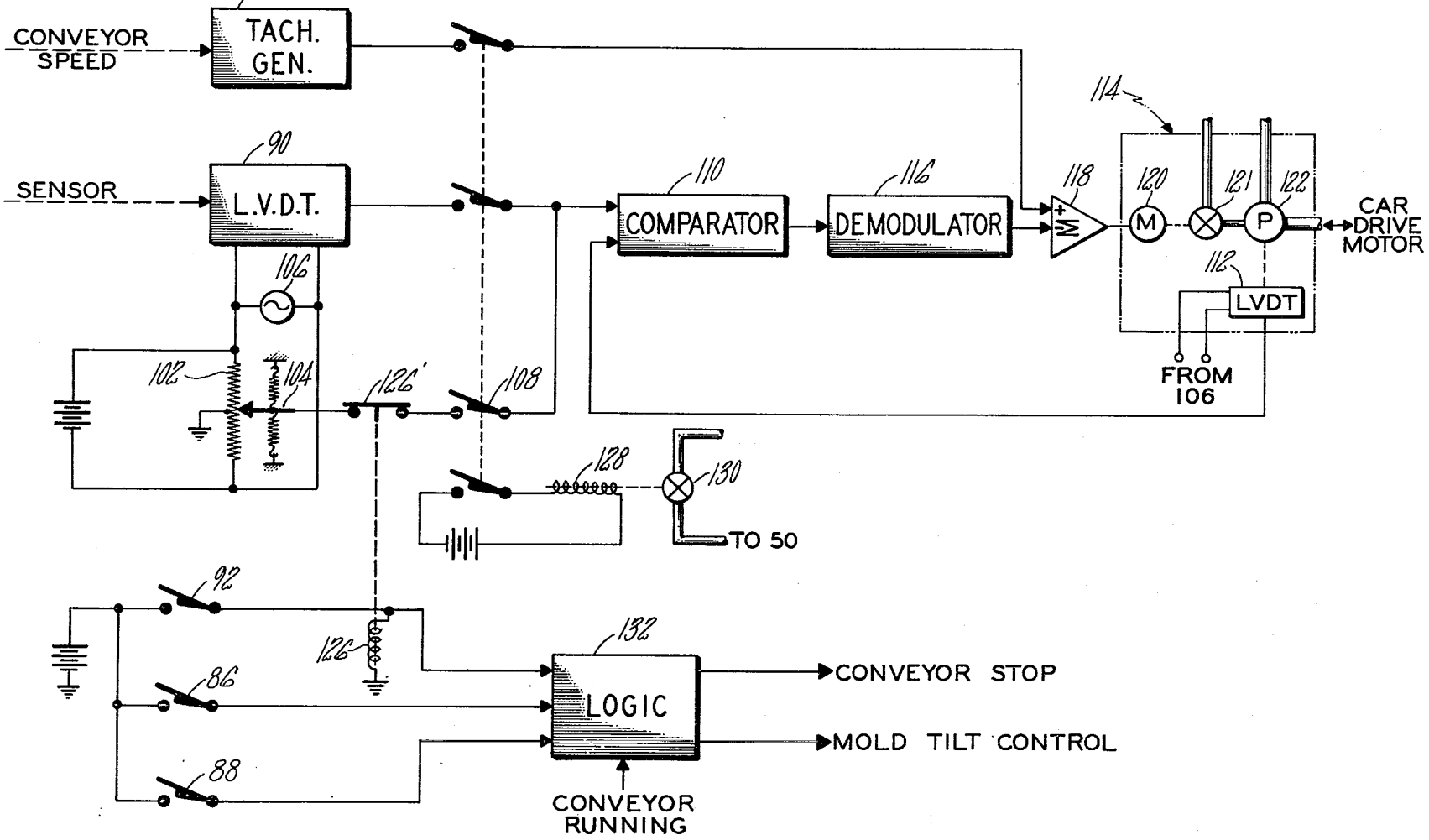
FIG. 5 is a functional block diagram which schematically depicts a velocity and position control in accordance with the present invention and employing the sensor mechanism of FIGS. 3 and 4.

Referring now to FIG. 5, a functional block diagram of a preferred embodiment of a control system employing the sensor mechanism of FIGS. 3 and 4 is disclosed. The control system receives, as input signals, the output voltage provided by LVDT 90, signals commensurate with the state of switches 86, 88 and 92 and the output of a tachometer generator 100. Tachometer generator 100 will typically provide a direct current voltage commensurate with the speed at which the conveyor is being driven; this speed being sensed at the conveyor drive motor. The output signals provided by LVDT 90 and tachometer generator 100 are utilized during the synchronization mode of operation. Prior to the time the probe is released from the retract position so as to permit the speed and position of the pouring car or other tool to be automatically synchronized with the speed and position of an object on a conveyor, a speed control input signal may be provided manually. The manual speed command is generated by a center-tapped potentiometer 102 having its wiper arm mechanically coupled to a joy stick or other control lever in the operator's cab 22. The joy stick, as indicated schematically at 104 on FIG. 5, is spring loaded so as to return to its center position, commensurate with no output voltage, upon release by the operator. The center tap of potentiometer 102 is grounded and a DC bias voltage is applied across the potentiometer. An AC voltage from an oscillator 106 is applied to LVDT's 90 and 112 and potentiometer 102. A synchronizing switch 108, or more precisely a plurality of ganged switches, are connected to an actuator either mounted on joy stick 104 or located at some other convenient place within the operator's cab. Considering the case where synchronization switch 108 is mounted on or actuated by the joy stick 104, when the operator is controlling speed manually a signal from the wiper arm of potentiometer 102 will be applied to a comparison circuit 110 and the switch contact in series with the LVDT 90 and tachometer generator 100 will be open. In the automatic synchronization mode, with the joy stick released by the operator, the switch contacts in series with the outputs of LVDT 90 and tachometer generator 100 will be closed and the contacts in series with the wiper arm of potentiometer 102 will be open. Comparator 110 also receives, as an input signal, a voltage provided by a second LVDT 112 in the servo system which is indicated generally at 114. The servo system 114 will be described in greater detail below.

The output signal from comparator 110 is applied to a demodulator 116. The output of demodulator 116, and the DC signal from tachometer generator 100, are applied to a summing circuit 118. The output of summing circuit 118 will be an error signal having a magnitude and polarity commensurate with differences in the relative velocity of the conveyor or an object on the conveyor and the speed of the apparatus on which the sensor assembly is mounted. This speed error signal is applied to a torque motor 120 in servo system 114. The torque motor output shaft drives, via a servo valve 121, the wobble plate of pump 122. The output of pump 122 is delivered to the pour car speed control hydraulic motor. The position of the wobble plate or tilt box of pump 122 thus determines both the speed and direction of movement of the pouring car. The LVDT 112 is a slave tranformer mechanically coupled to the wobble plate of pump 122; LVDT 112 thus providing a feedback signal commensurate with the actual speed of the pouring car. As discussed above, the signal generated by LVDT 112 is delivered as an input to comparator 110. Thus, to briefly summarize the speed control operation, variation of the position of the plunger in the master LVDT 90 produces a direct response from the slave LVDT 112 as the wobble plate angle of pump 122 is adjusted to trim the pouring car speed as necessary to achieve synchronization. The feedback of the signal commensurate with pump wobble plate position from LVDT 112 results in stepless control and, when synchronization has been obtained, the pouring car will follow the oscillatory forward motions of the mold; this tracking of the motion and position of the pouring car and mold being achieved without hunting since the plunger on LVDT 90 is in a low response region of cam 84 at synchronization.

The control system also includes a solenoid or similar device 126 which will be energized by the closing of the probe retract limit switch 92. Solenoid 126 will have a pair of contacts 126' in series with the wiper arm of potentiometer 102. The purpose of solenoid 126 is to prevent the operator from initially bringing the pouring car up to speed with the sensor probe in the dropped position.

The synchronization switch 108 also includes contacts in series with a solenoid 128 which controls operation of a valve 130 associated with cylinder 52. The closing of the switch 108 thus deenergizes cylinder 52 permitting the beam 46 and probe 44 to drop. The dropping and retracting of beam 46 may, of course, be controlled by an independently operable switch if desired.

If a totally automatic mode of operation is desired, a logic circuit 132 may be included in the control system. Logic circuit 132 would receive, among other inputs, the output signals from switches 86, 88 and 92. In response to its inputs, circuit 132 will provide output signals which control tilting of the mold. In the automatic control mode, fixed speed control bias voltages will be delivered from circuit 132 to comparator 110 prior to the dropping of the beams and probe.

Regardless of the mode of operation, once synchronization has been achieved an output signal from overtravel switch 88 will be employed to generate a conveyor stop command should the mold overtravel the sensor mechanism and thus the ladle. Should the mold stop the control system of the present invention will cause the pouring car to also stop with probe 44 against the mold side; i.e., with the system in the synchronized condition.

To now briefly discuss the operation of the present invention, with reference primarily to FIGS. 2 and 5, when the ladle 26 has been filled at furnace 42, the operator will bring the pouring car up to speed through the use of the joy stick 104. Presuming that the beam 46 is in the retract position, the solenoid contacts 126' which are controlled by switch 92 will be closed at this time and the synchronizing switch will be operated so as to apply the signal developed at potentiometer 102 to the input of comparator 110 to the exclusion of the signnal from LVDT 90. The output of tachometer generator 100 will also be isolated from the control at this time. The signal developed at potentiometer 102 under the control of the operator will thus be fed through comparator 110, demodulator 116, and summing circuit 118 to the torque motor 120 of the servo system 114. This will result in the wobble plate of pump 122 being driven to a position commensurate with the speed selected by the operator.

When the pour car is adjacent and slightly ahead of the mold to be poured, mold 16' in FIG. 2, the operator will release the joy stick and synchronization switch 108 will be operated. This will result in the outputs of tachometer generator 100 and LVDT 90 being applied to the system to exclusion of signals derived from potentiometer 102. The spring balance position of the sensor mechanism, as shown in FIG. 3, will result in LVDT 90 providing an output signal which is applied as a first input to comparator 110. This first comparator input signal is a speed command commensurate with a desired intercept speed which is slightly less than the conveyor drive speed. This speed command signal is compared in comparator 110 with the signal commensurate with actual pouring car speed as provided by slave LVDT 112 thus producing a signal commensurate with the difference between actual and desired pouring car speed. This difference signal is demodulated and summed with the tachometer output signal. The result of the summing in circuit 118 is a command signal which orders a pour car velocity slightly less than the conveyor drive speed. The pouring car will thus be moving at a velocity which will permit the mold to catch up therewith and begin applying force to prove 44. At this time; i.e., in the intercept portion of the synchronizing cycle; cams 82 and 84 will be in the position shown in FIGS. 3 and 4 and switch 86 will provide an indication that pouring is not yet authorized and the sensor arm overtravel signal from switch 88 is ignored.

When the mold catches up with the pouring car and applies force to probe 44, such force will be converted into a rotational moment and mechanically amplified in the manner described above so as to cause the rotation of cams 82 and 84. The rotation of cam 84 will bring the plunger of LVDT 90 into the central low response region of the cam and ultimately to the null position of the LVDT. When the LVDT core approaches null position the pour authorization switch 86 will move into a low region on cam 82 thus providing a pour authorization signal which permits the operator to begin tilting the ladle 26. In the synchronized condition the core of LVDT 90 will be at the null position and this tranformer will be providing no output signal. The pour call will at this time be traveling in synchronism with the mold and the position of the wobble plate of pump 122, as indicated by the output signal of LVDT 112, will correspond to a speed which is substantially equal to the speed at which the conveyor 14 is driven.

As is well known, objects mounted on a conveyor do not customarily move at a constant velocity but rather, because of oscillations along the conveyor, undergo an oscillatory forward movement. Any such oscillations will be sensed by probe 44 and will result in the core of LVDT 90 moving from its null position. However, since the zone of cam 84 to either side of the null position is a linear low response region, the control system will not overreact to such oscillatory variations in the mold relative velocity and position. The speed of the pouring car will thus be adjusted in response to output signals provided by LVDT 90 so as to maintain synchronism without hunting.

Should an overtravel occur, an output signal provided by switch 88 will, through the logic circuit 132, command the stopping of the conveyor so that the pouring of any mold then in progress can be completed. The performance of the control of the present invention is such that the conveyor will be stopped with the probe 44 against the side of the mold and the idler and input arms 48 and 50 will be vertically oriented; i.e., the synchronized conditions will be reacquired.

While a preferred embodiment has been shown and described, various modifications and substitutions may be made thereto without departing from the spirit and scope of the invention. Accordingly, it is to be understood that the present invention has been described by way of illustration and not limitation.

We claim:

1. Apparatus for controlling the velocity and position of movable tool with respect to a moving workpiece comprising:

linkage means, said linkage means including a moving beam and defining a parallelogram;

a workpiece contacting probe mounted on said beam, said probe being movable along an arcuate path;

a first cam, said fist having an operating surface contour which defines a plurality of response zones;

means coupling movements of said linkage means resulting from contact between said probe and a workpiece to said first cam to cause rotation of said first cam;

signal generator means, said signal generator means contacting said first cam operating surface whereby said signal generator provides an output signal which varies in accordance with the rotational position of said cam; and means responsive to said signal generator means output signal for varying the velocity of the tool.

2. The apparatus of claim 1 further comprising:

means for resiliently biasing said probe means to a first position commensurate with a desired workpiece intercept velocity.

3. The apparatus of claim 1 wherein said probe is movable with respect to said beam to selectively establish a desired relative position between the tool and workpiece.

4. The appartus of claim 1 wherein said coupling means comprises:

means for mechanically amplifying deflections of said beam resulting from probe-workpiece contact within at least a first band of relative velocities.

5. The apparatus of claim 1 further comprising:

means for moving said linkage means between an operative position and a retract position.

6. The apparatus of claim 1 further comprising:

a second cam, said second cam being mounted for rotation with said first cam and having an operating surface contour which defines a pluraity of response zones; and first limit switch means operatively associated with said second cam for providing an operational authorization signal upon synchronization of the movements of the tool and workpiece.

7. The apparatus of claim 6 further comprising:

second limit switch means operatively associated with said second cam, said second limit switch means providing an indication of workpiece overtravel with respect to the tool.

8. The apparatus of claim 2 wherein said movement coupling means includes:

a driver arm coupled at a first end to said linkage means, the second end of said driver arm describing an arcuate path in response to the application of force to said probe;

a Geneva arm coupled to said driver arm second end; and means connecting a first end of said Geneva arm to said first cam.

9. The apparatus of claim 8 further comprising:

a second cam, said second cam being mounted for rotation with said first cam and having an operating surface contour which defines a plurality of response zones; and first limit switch means operatively associated with said second cam for providing an operational authorization signal upon synchronization of the movements of the tool and workpiece.

10. The apparatus of claim 9 further comprising:

second limit switch means operatively associated with said second cam, said second limit switch means providing an indication of workpiece overtravel with respect to the tool.

11. The apparatus of claim 10 further comprising:

means for moving said linkage means between an operative position and a retract position.

12. The apparatus of claim 11 wherein said linkage moving means comprises:

double ended hydraulic cylinder means, said hydraulic cylinder means including a piston coupled at a first side of said cylinder means to said linkage means to cause the pivoting of said linkage means about the axis of rotation of said driver arm to raise or lower said beam and probe.

13. The apparatus of claim 12 wherein said resilient biasing means comprises:

a pair of opposed springs, said springs being mounted on extensions of piston rod extending from opposite ends of said hydraulic cylinder means.

14. The apparatus of claim 1 wherein said workpiece travels on a conveyor and said tool is caused to travel parallel to the conveyor by a variable speed hydraulic motor and wherein said means for varying the velocity of the tool comprises:

means for sensing the speed of the conveyor and generating a signal commensurate therewith;

means for generating a signal commensurate with the actual speed of the tool; and means for combining the signal provided by said signal generator means with the signal commensurate with actual speed and the signal commensurate with conveyor speed to generate a speed error signal;

a variable pump, said variable pump being hydraulically coupled to the tool hydraulic motor; and means responsive to said speed error signal for adjusting said pump to vary the speed of the tool hydraulic motor.

15. The apparatus of claim 14 wherein said means for combining signals to generate a speed error signal comprises:

means for comparing the signal commensurate with actual speed with the signal provided by said signal generator means to generate a first signal; and means for summing the signal commensurate with conveyor speed with the first error signal to generate a speed error signal.

16. The apparatus of claim 15 wherein said movement coupling means includes:

a driver arm coupled at a first end to said linkage means, the second end of said driver arm describing an arcuate path in response to the application of force to said probe;

a Geneva arm coupled to said driver arm second end; and means connecting a first end of said Geneva arm to said first cam.

17. The appartus of claim 16 further comprising:

a second cam, said second cam being mounted for rotation with said first cam and having an operating surface contour which defines a plurality of response zones; and first limit switch means operatively associated with said second cam for providing an operational authorization signal upon synchronization of the movements of the tool and workpiece.

18. The apparatus of claim 17 further comprising:

second limit switch means operatively associated with said second cam, said second limit switch means providing an indication of workpiece overtravel with respect to the tool.

19. The apparatus of claim 18 further comprising:

means for moving said linkage means between an operative position and a retract position.

20. The apparatus of claim 14 wherein the signal generator comprises:

a linear variable differential transformer, said transformer having a movable core and a core actuator in contact with said first cam, said core being in neutral position and the transformer providing no output voltage when the tool and workpiece are synchronized in speed and having the proper relative positioning.

* * * * *

UNITED STATES PATENT AND TRADEMARK OFFICE

CERTIFICATE OF CORRECTION

PATENT NO. : 4,033,403

DATED : July 5, 1977

INVENTOR(S) : William W. Seaton and George C. Miller

It is certified that error appears in the above-identified patent and that said Letters Patent are hereby corrected as shown below:

Column 2, line 25, change "contracted" to --contacted--

Column 3, line 31, "zero" should be --servo--

Column 3, line 42, cancel "The"

Column 3, line 43, cancel "operator a safe and comfortable vantage point."

Column 6, line 29, "top" should be --stop--

Column 9, line 62, "prove" should be --probe--

Column 10, line 15, "call" should be --car--

Column 10, line 58, (Claim 1, line 9), "fist" should be --first cam--

Column 12, line 4, (Claim 13, line 4), "rod" should be --rods--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*